United States Patent [19]

Stiennon

[11] 4,359,944

[45] Nov. 23, 1982

[54] AIRCRAFT OVERPRESSURE TRAP

[76] Inventor: Patrick J. G. Stiennon, 2227 Van Hise Ave., Madison, Wis. 53705

[21] Appl. No.: 170,775

[22] Filed: Jul. 21, 1980

[51] Int. Cl.[3] ..... F42B 23/18

[52] U.S. Cl. ..... 102/405; 89/1 A; 102/401

[58] Field of Search ..... 102/405, 401, 305, 306, 102/307, 310, 311, 701; 89/1 A

[56] References Cited

U.S. PATENT DOCUMENTS 3,090,306 5/1963 Reuther ..... 102/701

4,051,763 10/1977 Thomanek ..... 102/310

*Primary Examiner*—Charles T. Jordan

[57] ABSTRACT

My invention consists of a method of using the overpressure shock from a large number of air bursts, i.e., small explosives placed on the ground, to destroy aerial targets. The destruction of said aerial targets is effected by placing the explosive charges on a surface, all points of which are equidistant from the target. Alternately, the explosives are detonated on a surface which is NOT equidistant to the target at all points, but the explosives are delayed in such a manner that the shock wave from all of the explosive packages reach the target at the same time, they constructively interfere to cause a region of high overpressure which destroys the target.

6 Claims, 7 Drawing Figures

AIRCRAFT OVERPRESSURE TRAP

THE GENERAL BACKGROUND OF THE INVENTION

Air blast, i.e., the shock wave from an explosion in the air, is a nuisance in a commercial blasting operation because of the noise and the damage that can be caused to the surrounding buildings and property. In commercial blasting, every effort is made to lessen the effect of air blast by detonating the explosive in smaller delays, tamping the explosive, and blasting on days when the atmospheric conditions are such that there will not be a reflection of the blast wave to the ground.

For safety reasons, it is a bad practice to detonate an explosive charge when an aircraft is near the blast zone, as the blast wave may damage the aircraft.

This invention is directed to intentionally maximizing the air blast effect and controlling the direction of maximum intensity of the blast.

The advantage of using an airborne shock wave as a weapon against targets stems partly from the means of generating the destructive force and partly from the nature of the destructive force.

The mechanism of destruction is a field of overpressure, usually measured $lb/in^2$. An overpressure of 10 $lb/in^2$, though requiring only a few thousand pounds of high explosive at a distance of a thousand feet or more, with my invention, will exert a force of 1,440 $lb/ft^2$ on the wings of an aircraft which will cause failure of the wings and perhaps the entire structure of most aircraft.

Because the destructive force is a field, once detonated, the weapon is immune to counter measures. Armor will not protect the aircraft, as the force acts on the whole structure at once.

Because the weapon is new, the enemy will be unfamiliar with the means and mode of destruction, and as a result, the countermeasures and training in avoidance of the weapon will be underdeveloped.

The other advantages of the weapon stem from its method of generation. It is a fixed defensive weapon for infantry and installations. The weapon may be set up over dug-in infantry and utilized to destroy strafing ground-attack aircraft.

The weapon is difficult to destroy, because it is made up of hundreds of charges of explosives and can be spread over several million square feet of battlefield. The destruction of even a large number of charges will not render the weapon ineffectual.

The number of individual weapons that can be set up on a given area is limited only by the distance which must be left between explosive charges to prevent them from setting one another off. An area a thousand feet on a side, with three hundred individual chargers for each overpressure trap and three feet between charges, could contain over three hundred traps.

The weapon may function as an aerial tank trap, denying the use of certain low air corridors to the enemy, or preventing low-flying aircraft from gaining access to a protected area.

DETAILED DESCRIPTION OF THE INVENTION

For the purpose of this description and claims, an overpressure wave is the shock wave generated by a rapidly expanding source of gas. When as explosive is detonated, a solid or liquid explosive generates a cloud of gases at high temperature and high pressure, which creates a wave in the surrounding atmosphere, which then propagates out from the source, causing what is known as an overpressure, and conventionally measured as pounds per square inch over atmosphere.

This invention is directed to using this phenomenon, the shock wave from an explosive, to destroy airborne vehicles.

Since the strength of the overpressure wave decreases with the square of the distance from an explosive, the shock wave from a single explosive rapidly attenuates with distance. This invention is directed to overcoming attenuation with distance by using a concave shock wave mirror, or simulated mirror. The mirror, which can consist of any rigid surface, is not used to concentrate a shock wave of a single explosive, rather it is used as an emitting surface. By placing a large number of small explosive packages on the surface of the shock wave mirror, said mirror acts as a highly reflective mirror from a single large shock wave, or alternately, as a diffuse emitting surface.

Figure 1:
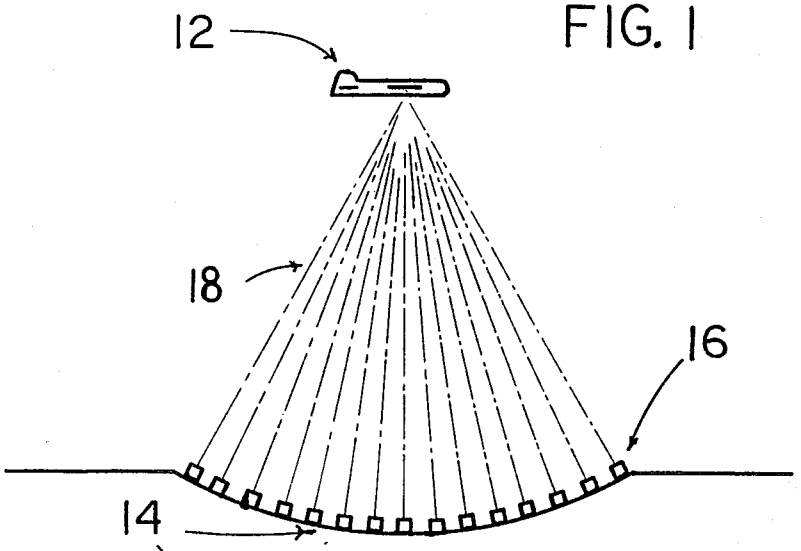
FIG. 1 shows an overpressure trap in an elevation which is laid out in a spherical depression with an aircraft at the focus of the trap.

FIG. 1 of the drawings shows one such example of a shock wave mirror. In the figure, the target 12, an aircraft, passes over the center of a sphere. Where the sphere intersects the ground, the earth has been removed to form a circular depression.

Upon the surface of this section of the sphere, which acts as the rigid emitting surface 14, a multiplicity of small explosive packages 16 are placed.

When the explosive packages are detonated simultaneously, a shock wave from each one travels outward in all directions. The lines indicated by 18 trace the expanding shock wave from each explosive in the direction of the target 12. Because all points on a sphere are equidistant from the center, the shock wave from the multiplicity of explosive packages arrives at the target 12 at the same time.

Figure 2:
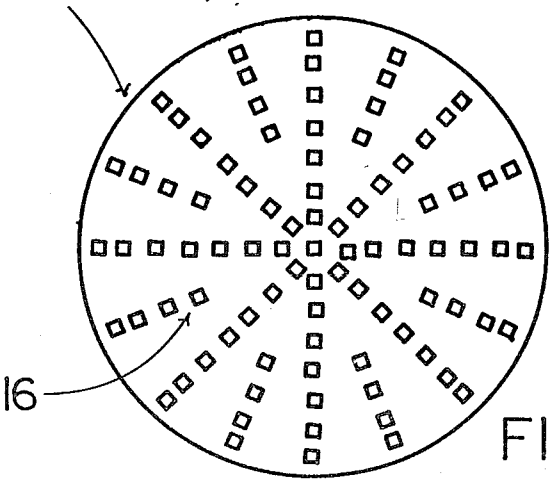
FIG. 2 is a plan view of the pattern of the explosives in FIG. 1.

FIG. 2 shows a plan view of a possible layout for the explosives on the surface of the sphere. While FIG. 2 shows a systematic pattern of explosives laid out upon the rigid surface 14, almost any pattern, even a random pattern, of explosives laid out on the surface 14 would cause the desired localized region of high overpressure at the center, focus, of the sphere.

The dimensions of the explosive patterns range from several hundred to several thousand feet, with the resulting height of an effective destructive overpressure being one-half to three times the diameter of the blast pattern.

Digging a spherical depression of such magnitude would be difficult or impractical, in most cases, unless the land already conformed with such a depression.

Figure 3:
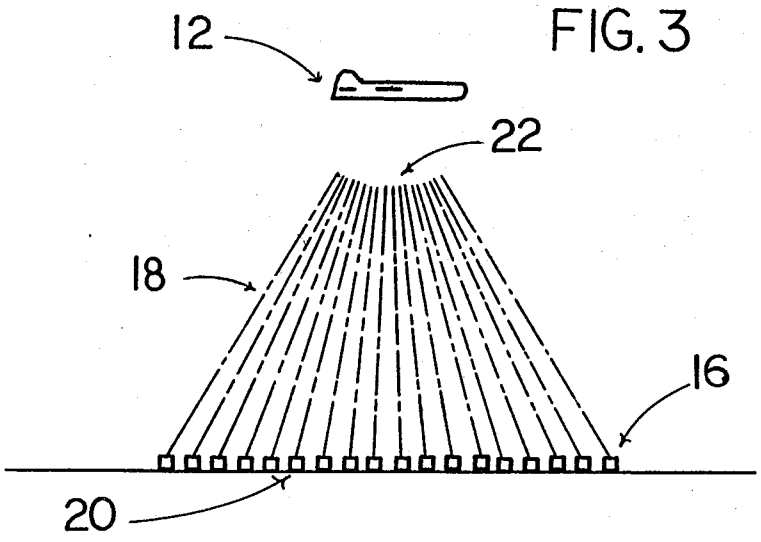
FIG. 3 shows an overpressure trap in elevation where the spherical geometry of FIG. 1 is simulated by the uses of delays.

FIG. 3 shows a method and a pattern whereby the curved shape of the rigid reflecting surface may be simulated. In FIG. 3, the small explosive packages 16 are placed on a plainer surface 20, usually the ground. The explosives are then detonated in such a manner that the shock waves all reach the focus, i.e., the target 12 at the same time. This is accomplished by detonating the explosives most distant from the target first, then the next furthest, and the next, and so on until the closest explosives to the target 12 are detonated last.

The delays between each successive set of charges are determined by the relative distance and the time it takes for the furthest wave to catch up with the closer waves, so that they all arrive at the target 12, at the same time.

Twenty-two (22) shows the front of the advancing overpressure shock wave from all of the explosives. It may be noted that when the explosives are set off in the proper sequence, the shape of the shock wave at any moment before reaching the target 12, is that of a section of a sphere. The face view in FIG. 3 shows at 22 a circular shape.

Figure 4:
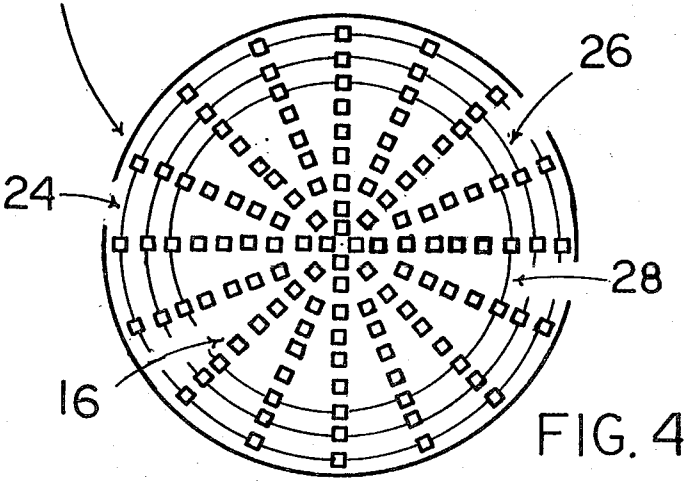
FIG. 4 shows a plan view of the pattern of explosives in FIG. 3.

FIG. 4 shows a plan view of a possible layout for the small explosive packages 16, as used in FIG. 3. In order for this pattern to function properly, first the series of explosives designated as 24 would be detonated, then the explosives designated as 26 would be detonated after sufficient delay so that the shock waves from both rings would reach the target 12 at the same time. Likewise, explosive charges in ring 28 are detonated in sequence in like manner to those in 26, and so on in toward the center. After the center charges are detonated, the shock wave has taken the form of an upward concave shell similar to that of a section of the sphere.

Figure 5:
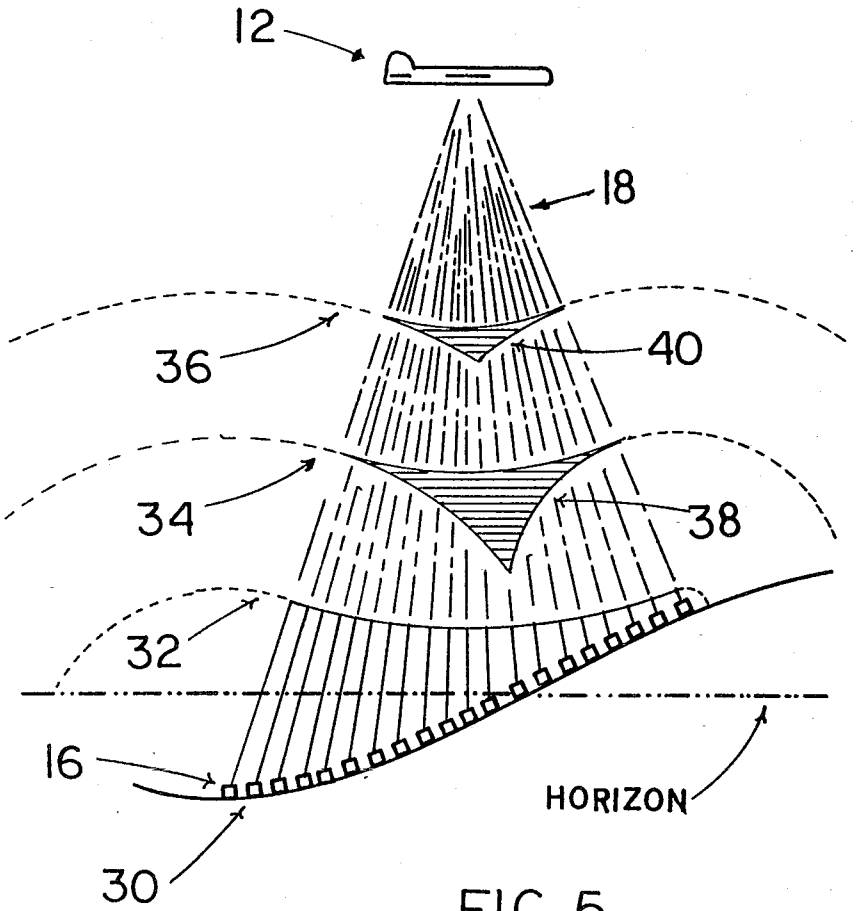
FIG. 5 shows an overpressure trap in elevation view on an uneven terrain with the target off center, and also shows the shape of the wave front as it travels toward the target.

FIG. 5 shows a generalized view of how my invention can be used to hit and destroy a target with an overpressure wave from an uneven surface, provided the target is within range of the weapon. In FIG. 5 the small packages of explosives 16, which may range from one to several tens of pounds, are placed on the side of the hill 30, which acts as the rigid surface. The explosives are then detonated so as to reach the surface 32, which is a section of the sphere, with the target 12 at its center. Proper delay for the explosive charges can be calculated from a figure, such as FIG. 5 by measuring the distance from the surface 30 to the shock wave surface at a given time and translating this distance into time by dividing by the rate at which the shock wave propagates. This time represents the amount of lead time that the most distant explosive must be detonated before the closest. The explosive overpressure wave at the surface 32 can be seen to progress to surface 34, then to surface 36, all shown here in cross section. As the shock wave approaches the target 12, the size of the spherical surface decreases until all shock waves intersect at the target.

FIG. 5 may also be used to demonstrate the theoretical validity of the weapon. As the shock wave expands because it is a surface, spherical phenomenon, the overpressure from a single explosive wave decreases with approximately the square of the distance from the explosive package. The volume in which the multiplicity of explosive shock waves constructively interfere, however, decreases with the cube of the distance from the entire explosive pattern. This volume of constructive interference is shown in cross section in FIG. 5 and designated as 38 at the point where the shock wave has reached the surface 34 and 40 at the point in time when the shock wave has reached surface 36. It can be seen from the diagram how rapidly this volume decreases with distance from the explosive pattern. As the constructive interference volume decreases in size, the number of waves and constructive interference therein does not decrease. It may be seen, therefore, that the density of overpressure wave's constructive interference's increases with the cube of the distance from the radiating surface 30, whereas the strength of the individual shock wave from the small explosive packages 16 decreases as the square. The net result is an increasing overpressure as the wave approaches the target 12.

Figure 6:
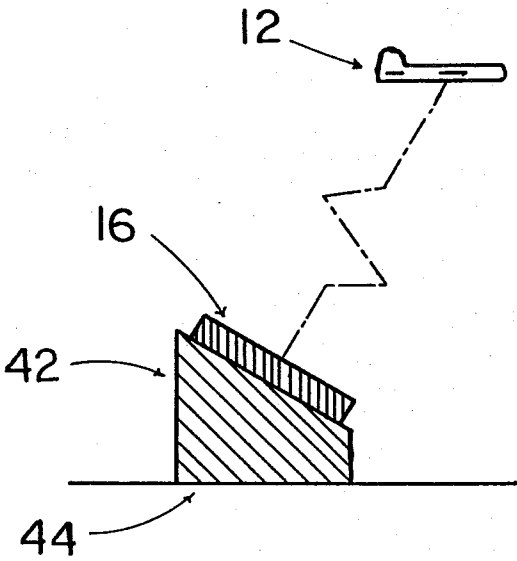
FIG. 6 shows an elevation view of a single charge of explosives mounted so as to direct the shock wave in the direction of the target; and, FIG. 7 shows a block diagram of one means of detonating the explosive pattern in a given sequence.

FIG. 6 shows a method of increasing the force directed at the target 12 by the small package of explosives 16. By making the explosives relatively thin, in the direction of the target, and/or mounting it on a rigid block 42 on the surface 44 so that both the initial shock wave and the reflected wave from the rigid surface are aligned with the target 12.

Figure 7:
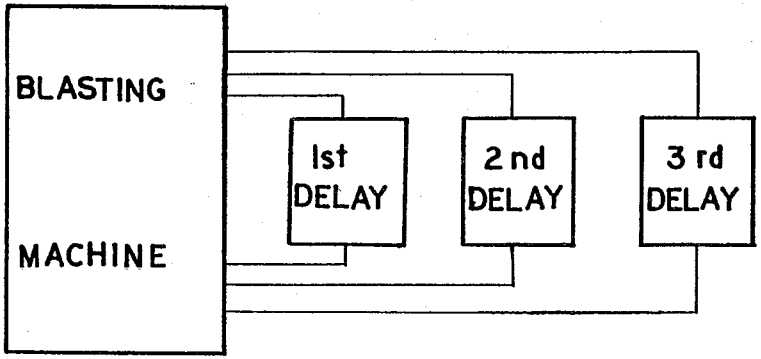

FIG. 7 shows a schematic of a blasting machine and three separate delays, such as would be used to set off the first delays in FIG. 4. Delay 1 would be explosive charges 24; delay 2 would be explosive charges 26; delay 3 would be explosive charges labeled 28. A blasting machine alone, or a blasting machine in connection with time-delayed blasting caps, or delays attached to detonating cord, may be used to get the proper time delay for the various explosive packages in a blasting pattern. By changing the design of the delays, the focus of a given blasting pattern may be changed, so as to intersect with a given target.

In order to get maximum effectiveness from this weapon, the explosive packages must be detonated before the target reaches the focus, because the blast wave travels at the speed of sound or slightly in excess thereof, so it is necessary to lead the target so that both the shock wave and the target reach the focus at the same time.

The most versatile configuration of my weapon would consist of a sophisticated blasting machine, a microprocessor and a radar installation, or other instruments which give course and heading. From the radars course and heading information, the future position of the aircraft would be plotted. Then a microprocessor would be used to re-program the blasting machine to fire the small explosive packages in such a way as to bring the overpressure trap into focus on the predicted path of the aircraft.

I claim:

1. An apparatus for destroying airborne vehicles with an overpressure wave, which comprises:

a. a multiplicity of explosive charges;

b. a rigid surface;

c. a means for detonating said explosive charges, which are placed on said rigid surface and detonated, so that the overpressure wave from each explosive charge reaches a focus at the same time, whereby an aircraft at said focus is impinged upon by the sum of the overpressure waves from each of the multiple explosive charges.

2. An apparatus for destroying airborne vehicles as recited in claim 1, in which the rigid surface comprises:

a. part of the surface of a sphere, center of said sphere being the focus of an overpressure trap, whereby, when the explosive charges are placed on the spherical surface and detonated simultaneously, the overpressure wave from each charge reaches the focus at the same time.

3. An apparatus for destroying airborne vehicles as recited in claim 1, in which the largest lineal distance across the overpressure trap surface is at least one-half that of the distance from the centroid of the surface to the focus of the overpressure trap.

4. An appartus for destroying airborne vehicles, as recited in claim 1, in which said explosive charges are placed on a rigid base with, at least, one flat side which is facing said focus, the explosive charge, is placed on said flat face, and the base is placed on said rigid surface.

5. A method of creating a localized region of high overpressure above a rigid surface which comprises:

a. placing a multiplicity of explosive charges on the exposed side of the rigid surface; and, b. detonating said explosive charges with such delay for each explosive charge that the overpressure wave from each explosive charge reaches the focus at the same time, whereby the target is subjected to all the overpressure waves at the same time.

6. A localized region of overpressure above a rigid surface created in accordance with the process of claim 5.

* * * * *